US010954625B2

(12) United States Patent
Jo et al.

(10) Patent No.: US 10,954,625 B2
(45) Date of Patent: Mar. 23, 2021

(54) LAUNDRY TREATMENT APPARATUS

(71) Applicant: LG Electronics Inc., Seoul (KR)

(72) Inventors: Mingyu Jo, Seoul (KR); Gon Kim, Seoul (KR); Kwanghyun Kim, Seoul (KR); Woongkil Cha, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 300 days.

(21) Appl. No.: 15/831,910

(22) Filed: Dec. 5, 2017

(65) Prior Publication Data

US 2018/0155863 A1 Jun. 7, 2018

(30) Foreign Application Priority Data

Dec. 7, 2016 (KR) ..... 10-2016-0165954

(51) Int. Cl.
*D06F 25/00* (2006.01)
*D06F 37/12* (2006.01)
(Continued)

(52) U.S. Cl.
CPC ..... *D06F 39/085* (2013.01); *D06F 25/00* (2013.01); *D06F 34/28* (2020.02); *D06F 37/12* (2013.01);
(Continued)

(58) Field of Classification Search
CPC ..... D06F 25/00; D06F 37/12; D06F 37/266; D06F 37/24; D06F 37/304; D06F 39/005;
(Continued)

(56) References Cited

U.S. PATENT DOCUMENTS 3,266,274 A * 8/1966 Schwing ..... D06F 39/08 68/18 FA
3,867,821 A * 2/1975 Hurwitz ..... D06F 17/04 681/184

(Continued)

FOREIGN PATENT DOCUMENTS

DE 102009046856 A1 6/2010
EP 2843120 A2 3/2015

(Continued)

*Primary Examiner* — Joseph L. Perrin
(74) *Attorney, Agent, or Firm* — Dentons US LLP

(57) ABSTRACT

A laundry treatment apparatus is disclosed. The laundry treatment apparatus includes a tub provided in a cabinet for storing water, a water supply unit for supplying water to the tub, a drum rotatably provided in the tub for storing laundry, a first pump including a first housing for receiving water discharged from the tub and an impeller rotatably provided in the first housing for discharging the water introduced into the first housing out of the first housing, a drainage pipe configured to extend through a height higher than the maximum possible level of water in the tub for guiding the water discharged from the first housing out of the cabinet, and a second pump including a first gear and a second gear rotatably provided in a second housing, into which the water discharged from the tub is introduced, the second pump being configured to move the water introduced into the second housing to the drainage pipe when the first gear and the second gear are rotated.

8 Claims, 4 Drawing Sheets

(51) Int. Cl.

| | |
|---|---|
| ***D06F 37/26*** | (2006.01) |
| ***D06F 37/24*** | (2006.01) |
| ***D06F 39/08*** | (2006.01) |
| ***D06F 37/30*** | (2020.01) |
| ***D06F 34/28*** | (2020.01) |
| *F04C 11/00* | (2006.01) |
| *F04C 2/18* | (2006.01) |
| *F04C 2/10* | (2006.01) |

(52) U.S. Cl.
CPC ..... *D06F 37/24* (2013.01); *D06F 37/266* (2013.01); *D06F 37/304* (2013.01); *D06F 39/083* (2013.01); *D06F 39/088* (2013.01); *F04C 2/101* (2013.01); *F04C 2/18* (2013.01); *F04C 11/005* (2013.01); *F04C 2210/1094* (2013.01)

(58) Field of Classification Search
CPC .... D06F 39/083; D06F 39/085; D06F 39/088; D06F 34/28
See application file for complete search history.

(56) References Cited

U.S. PATENT DOCUMENTS

| | | | | |
|---|---|---|---|---|
| 6,053,718 | A * | 4/2000 | Schmidt | F01C 21/104 418/152 |
| 6,402,962 | B1 * | 6/2002 | Bruntz | B01D 29/66 210/108 |
| 2004/0166010 | A1 * | 8/2004 | Lafferty | F04C 2/086 418/206.7 |
| 2009/0126418 | A1 * | 5/2009 | Shin | D06F 35/00 68/208 |
| 2009/0158784 | A1 * | 6/2009 | Kim | D06F 31/00 68/27 |
| 2013/0305462 | A1 | 11/2013 | Gasparini et al. | |
| 2015/0059202 | A1 * | 3/2015 | Kim | D06F 58/28 34/487 |
| 2015/0059413 | A1 * | 3/2015 | Yoo | D06F 33/02 68/20 |

FOREIGN PATENT DOCUMENTS

| | | | |
|---|---|---|---|
| JP | 2007-135807 | A | 6/2007 |
| KR | 10-0792522 | B1 | 1/2008 |
| KR | 20-2009-0003853 | U | 4/2009 |
| KR | 10-2015-0029925 | A | 3/2015 |

* cited by examiner

LAUNDRY TREATMENT APPARATUS

This application claims the benefit of Korean Patent Application No. 10-2016-0165954, filed on Dec. 7, 2016 which is hereby incorporated by reference as if fully set forth herein.

BACKGROUND OF THE INVENTION

Field of the Invention

The present invention relates to a laundry treatment apparatus.

Discussion of the Related Art

A laundry treatment apparatus is an electric home appliance capable of washing laundry, drying laundry, or both washing and drying laundry.

A conventional laundry treatment apparatus for washing includes a cabinet, a tub provided in the cabinet for storing water, a drum rotatably provided in the tub, a water supply unit for supplying water to the tub, and a drainage unit for discharging the water stored in the tub out of the cabinet.

In the conventional laundry treatment apparatus, the drainage unit generally includes a pump, a connection pipe for guiding the water in the tub to the pump, and a drainage pipe for guiding the water discharged from the pump out of the cabinet.

Meanwhile, the drainage pipe provided in the conventional laundry treatment apparatus is generally configured to extend through a height higher than the maximum level of water in the tub in order to store water in the tub without providing a separate valve in the drainage pipe. The pump provided in the conventional laundry treatment apparatus is configured to move the water discharged from the tub to the drainage pipe through an impeller that is rotated by a motor. The pump including the impeller cannot open and close the connection pipe or the drainage pipe due to the structure thereof.

In the conventional laundry treatment apparatus, therefore, some of the water in the drainage pipe moves to the pump when the operation of the pump is stopped (when the rotation of the impeller is stopped).

In addition, when the operation of the pump is stopped, the water moving to the pump may return to the tub through the connection pipe. This means that water to be drained remains in the tub, whereby the washing performance of the laundry treatment apparatus may be reduced. Also, in the case in which the laundry treatment apparatus is also capable of drying laundry, the drying performance of a drying cycle performed after washing may be reduced.

SUMMARY OF THE INVENTION

Accordingly, the present invention is directed to a laundry treatment apparatus that substantially obviates one or more problems due to limitations and disadvantages of the related art.

An object of the present invention is to provide a laundry treatment apparatus that is capable of preventing water from remaining in a tub.

Additional advantages, objects, and features will be set forth in part in the description which follows and in part will become apparent to those having ordinary skill in the art upon examination of the following or may be learned from practice. The objectives and other advantages may be realized and attained by the structure particularly pointed out in the written description and claims hereof as well as the appended drawings.

To achieve these objects and other advantages and in accordance with the purpose of the invention, as embodied and broadly described herein, in accordance with an aspect of the present invention, a laundry treatment apparatus includes a cabinet, a tub provided in the cabinet for storing water, a water supply unit for supplying water to the tub, a drum rotatably provided in the tub for storing laundry, a first pump including a first housing for receiving water discharged from the tub and an impeller rotatably provided in the first housing for discharging the water introduced into the first housing out of the first housing, a drainage pipe configured to extend through a height higher than the maximum possible level of water in the tub for guiding the water discharged from the first housing out of the cabinet, and a second pump including a first gear and a second gear rotatably provided in a second housing, into which the water discharged from the tub is introduced, the second pump being configured to move the water introduced into the second housing to the drainage pipe when the first gear and the second gear are rotated.

Each of the first gear and the second gear may be an external gear.

One of the first gear and the second gear may be an external gear, and the other of the first gear and the second gear may be an internal gear, which has a diameter greater that the diameter of the external gear and which is rotated by the external gear.

The laundry treatment apparatus may further include a first connection pipe configured to connect the first housing to a lower region of the tub and a second connection pipe configured to connect the second housing to any one of the lower region of the tub, the first connection pipe, and the first housing.

The laundry treatment apparatus may further include a circulation duct configured to define a channel for discharging air in the tub out of the tub and guiding the air discharged out of the tub into the tub, a fan provided in the circulation duct for circulating the air in the tub, a heater provided in the circulation duct for heating air, an intake duct for introducing air outside the tub into the circulation duct, and an exhaust duct for discharging some of the air introduced into the tub out of the tub.

The intake duct and the exhaust duct may remain open during the operation of the heater and the fan.

The intake duct may be provided in a channel along which the air in the tub is introduced into the fan.

The laundry treatment apparatus may further include a body, a partition for partitioning the interior of the body into two spaces, a first inlet port located in one of the two spaces defined by the partition for introducing the air discharged through the exhaust duct into the body, a second inlet port located in the other of the two spaces defined by the partition for introducing the water discharged from the first housing into the body, an outlet port located in the space in which the first inlet port is located for discharging a fluid in the body to the drainage pipe, a partition through-hole formed through the partition for allowing the space in which the first inlet port is located and the space in which the second inlet port is located to communicate with each other, and a ball for closing the first inlet port when water is introduced into the body and opening the first inlet port when no water is introduced into the body, the ball having a diameter greater than the diameter of the first inlet port.

The laundry treatment apparatus may further include a first discharge pipe for guiding the water discharged from the first housing to the second inlet port and a second discharge pipe for guiding the water discharged from the second housing to any one of the drainage pipe and the body.

The second discharge pipe may be configured to interconnect the second housing and the first inlet port or to interconnect the second housing and the outlet port.

The first inlet port and the second inlet port may be disposed vertically in the state in which the partition is disposed therebetween, and the partition may be provided with a location recess, which is bent concavely toward the second inlet port such that the ball is located at a lower part of the first inlet port.

It is to be understood that both the foregoing general description and the following detailed description of the present invention are exemplary and explanatory and are intended to provide further explanation of the present invention as claimed.

BRIEF DESCRIPTION OF THE DRAWINGS

The accompanying drawings, which are included to provide a further understanding of the present invention and are incorporated in and constitute a part of this application, illustrate embodiment(s) of the present invention and together with the description serve to explain the principle of the present invention. In the drawings.

DETAILED DESCRIPTION OF THE INVENTION

Reference will now be made in detail to the preferred embodiments of the present invention, examples of which are illustrated in the accompanying drawings. Meanwhile, the construction or control method of an apparatus, which will be described hereinafter, are disclosed only to describe embodiments of the present invention, and therefore the scope of the present invention is not limited thereby. Wherever possible, the same reference numbers will be used throughout the drawings to refer to the same or like parts.

A laundry treatment apparatus according to the present invention may be configured as an apparatus that performs only washing or as an apparatus that performs both washing and drying. The following description will be given of a laundry treatment apparatus configured as an apparatus that performs both washing and drying.

Figure 1:
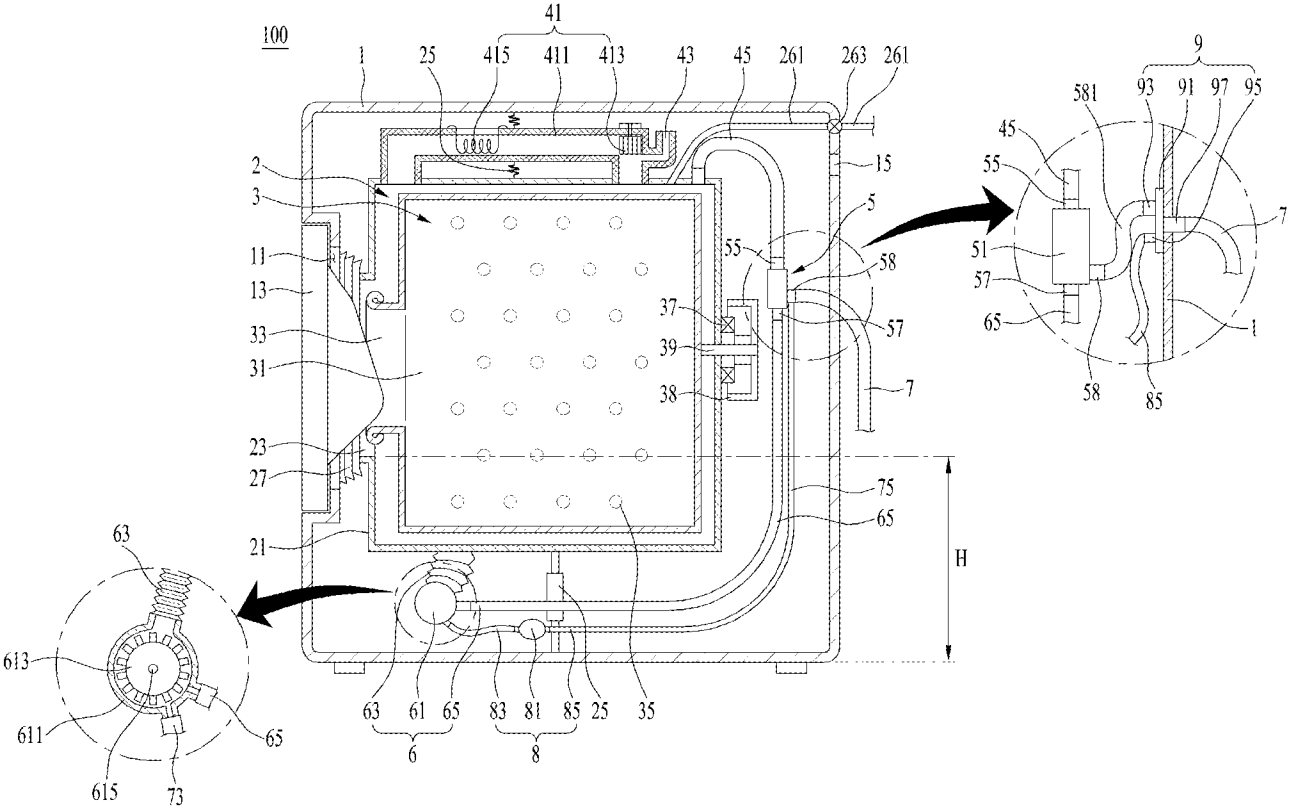
FIG. 1 is a view showing an example of a laundry treatment apparatus according to the present invention.

As shown in FIG. 1, a laundry treatment apparatus 100 according to the present invention includes a cabinet 1 defining the external appearance thereof, a tub 2 provided in the tub for storing water, a drum 3 rotatably provided in the tub for storing laundry, and a hot air supply unit 41 and 43 for supplying heated air to the tub.

The cabinet 1 includes a front panel, which defines the front surface of the laundry treatment apparatus. The front panel is provided with an introduction port 11, through which laundry is introduced into or removed from the drum. The introduction port 11 is opened and closed by a door 13, which is hinged to the cabinet 1.

In addition, the front panel may be provided with a control panel 15, which is a user interface. The control panel 15 is a means for allowing a user to exchange information with a controller (not shown) of the laundry treatment apparatus 100.

The cabinet 1 is provided with a cabinet through-hole 15, through which the inside and the outside of the cabinet communicate with each other. FIG. 1 shows an example in which the cabinet through-hole 15 is formed through the rear of the cabinet. The cabinet through-hole 15 is a means for introducing air necessary to operate the hot air supply unit into the cabinet 1. Unless the cabinet 1 forms a completely sealed space, the cabinet through-hole 15 may be omitted.

The tub 2 may include a cylindrical tub body 21 that defines a space for storing water. The tub body 21 is fixed in the cabinet 1 via a tub support unit 25.

The tub body 21 is provided at the front thereof with a tub introduction port 23, which communicates with the introduction port 11. A gasket 27 may be provided between the tub introduction port 23 and the introduction port 11. The gasket 27 may be made of an elastic material, such as rubber, in order to prevent vibration generated by the tub 2 from being transmitted to the cabinet 1 and to prevent water stored in the tub 2 from leaking out of the tub.

Water is supplied to the tub 2 through a water supply unit. The water supply unit may include a water supply pipe 261 interconnecting the tub body 21 and a water supply source (not shown) and a water supply valve 263 for opening or closing the water supply pipe 261 under the control of the controller (not shown).

The drum 3 includes a drum body 31 rotatably provided in the tub body 21 and a through-hole 35 formed through the drum body for allowing communication between the tub body and the drum body.

The drum body 31 is provided at the front thereof with a drum introduction port 33. The drum introduction port 33 communicates with the introduction port 11, which is provided at the front surface of the cabinet.

The drum body 31 is rotated by a drum driving unit provided at the rear of the tub 2. The drum driving unit may include a stator 37 fixed to the rear of the tub for generating a rotating field, a rotor configured to be rotated by the rotating field, and a drum rotating shaft 39 extending through the rear of the tub for interconnecting the drum body 31 and the rotor 38.

The hot air supply unit may include a circulation channel 41 and a fan 413 and a heater 415 provided in the circulation channel.

The circulation channel 41 may include a circulation duct 411 for discharging air in the tub body 21 out of the tub body 21 and then guiding the discharged air into the tub body 21. In this case, the fan 413 and the heater 415 may be provided in the circulation duct 411.

In the case in which the hot air supply unit may is configured to circulate the air in the tub body through the circulation duct 411, the hot air supply unit requires a dehumidification unit for dehumidifying air discharged from the tub body 21. The dehumidification unit may include an intake duct 43 provided in the circulation duct 411 and an exhaust duct 45 provided in the tub body 21.

The intake duct 43 is a means for introducing air outside the tub body 21 into the circulation duct 411. The intake duct 43 may be connected to a space between the tub body 21 and the fan 413 in a channel defined by the circulation duct 411. In this structure, air outside the tub body 21 is introduced into the circulation duct 411 when the fan 413 is rotated to supply air to the tub body 21.

The exhaust duct 45 is a means for discharging air discharged from the tub body 21 out of the cabinet. The form of the exhaust duct 45 is not particularly restricted as long as the tub body 21 is connected to the outside of the cabinet 1 through the exhaust duct 45.

In the laundry treatment apparatus having the above structure, when the fan 413 is operated, the air in the tub body 21 is introduced into the circulation duct 411, the air introduced into the circulation duct 411 is heated by the heater 415, and the heated air is supplied to the tub body 21. The air supplied to the tub body 21 exchanges heat with the laundry stored in the drum body 31.

Since the tub body 21 exchanges heat with air in the cabinet 1 (or air introduced into the cabinet through the cabinet through-hole 15), the temperature of the surface of the tub body 21 remains lower than the temperature of the center of the tub body 21. After being discharged from the drum body 31, therefore, the air is cooled while moving to the circulation duct 411, whereby some of the moisture contained in the water is condensed on the inner circumferential surface of the tub body 21.

Meanwhile, some of the air that has exchanged heat with the laundry is discharged out of the tub body 21 through the exhaust duct 45, and the remaining air is collected in the circulation duct 411. The air introduced into the circulation duct 411 is mixed with external air introduced through the intake duct 43.

The air discharged from the drum body 31 exchanges heat with the inner circumferential surface of the tub body 21 while moving to the circulation duct 411, whereby the air is dehumidified. However, the air may not be sufficiently dehumidified depending on the amount of the laundry (the amount of the laundry stored in the drum). The exhaust duct 45 and the intake duct 43 are provided to solve the above problem.

That is, in the present invention, some of the air moving from the tub body 21 to the circulation duct 411 is charged out of the cabinet 1 through the exhaust duct 45, whereby the amount of wet air introduced into the circulation duct 411 is reduced. In addition, dry air supplied through the intake duct 43 (air outside the tub) is mixed with the air introduced from the tub body 21 to the circulation duct 411, whereby the humidity of the air to be supplied to the heater 415 may be reduced to a desired level.

In the present invention, therefore, it is possible to dry laundry without a separate dehumidification device that supplies water from the water supply source to the circulation duct. In order to achieve the above effect, the exhaust duct 45 and the intake duct 43 may open during the operation of the fan.

Meanwhile, the water stored in the tub body 21 is discharged out of the cabinet 1 through a discharge unit 6, 7, and 8. The discharge unit may include a first drainage unit 6 and a drainage pipe 7 for moving the water stored in the tub body 21 out of the cabinet 1.

The first drainage unit 6 may include a first connection pipe 63 communicating with the inside of the tub body 21, a first discharge pipe 65 connected to the drainage pipe 7, and a first pump 61 for moving the water supplied from the first connection pipe 63 to a second discharge pipe.

The first pump 61 may include a first housing 611 interconnecting the first connection pipe 63 and the first discharge pipe 65 and an impeller 613 rotatably provided in the first housing. The impeller 613 is configured to be rotated through a rotary shaft 615 of a first motor located outside the first housing 611.

The drainage pipe 7 is configured to extend through a height higher than the maximum possible level H of water in the tub body 21. The drainage pipe 7 is a means for guiding the water supplied through the first discharge pipe 65 to a drain (not shown) provided outside the cabinet.

In the case in which the drainage pipe 7 is provided higher than the maximum level of water in the tub, the water supplied through the water supply unit may be stored in the tub body 21 without a separate valve in the first discharge pipe 65 or the drainage pipe 7.

Meanwhile, the exhaust duct 45 may be connected to any one of the first discharge pipe 65 and the drainage pipe 7. The air discharged through the exhaust duct 45 is highly humid air. If the exhaust duct 45 is configured to directly communicate with the outside of the cabinet 1, therefore, air discharged from the exhaust duct 45 may condense on an indoor wall.

In order to solve this problem, the exhaust duct 45 may be connected to the first discharge pipe 65 and the drainage pipe 7 via a channel switch unit 5.

Figure 2:
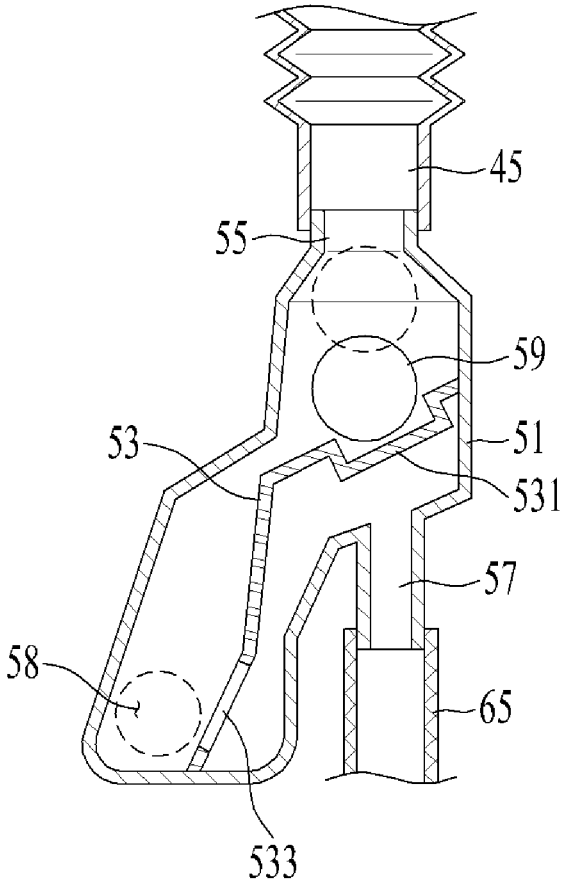
FIG. 2 is a view showing an example of a channel switch unit provided in the laundry treatment apparatus according to the present invention.

As shown in FIG. 2, the channel switch unit 5 may include a body 51 interconnecting the exhaust duct 45, the first discharge pipe 65, and the drainage pipe 7, a partition 53 for partitioning the interior of the body into two spaces, and a ball 59 provided in the body 51 for opening and closing the exhaust duct 45 depending on whether water is introduced into the body 51 through the first discharge pipe 65. The ball 59 may have a diameter greater than that of a first inlet port 55.

The body 51 includes a first inlet port 55, to which the exhaust duct 45 is connected, a second inlet port 57, to which the first discharge pipe 65 is connected, and an outlet port 58, to which the drainage pipe 7 is connected.

The first inlet port 55 may be located in one of the two spaces defined in the body 51 by the partition 53, and the second inlet port 57 may be located in the other of the two spaces defined in the body 51. The outlet port 58 may be located in the space in which the first inlet port 55 is located.

The partition wall 53 may include a partition through-hole 533, through which the space in which the first inlet port 55 is located and the space in which the second inlet port 57 is located communicate with each other, and a location recess 531 for allowing the ball 59 to be located at the lower part of the first inlet port 55.

In the case in which the first inlet port 55 and the second inlet port 57 are disposed vertically in the state in which the partition 53 is disposed therebetween, the location recess 531 may be bent concavely toward the second inlet port 57 such that the ball 59 is located at the lower part of the first inlet port 55.

In the laundry treatment apparatus 100 having the above structure, when the first pump 61 is not operated, the ball 59 is located in the location recess 531 provided in the partition in order to open the first connection pipe 63. When the fan 413 and the heater 415 are operated in this state, the air discharged through the exhaust duct 45 is discharged out of the cabinet 1 through the outlet port 58 and the drainage pipe 7.

When the first pump 61 is operated, on the other hand, the water stored in the tub body 21 is introduced into the body 51 through the first connection pipe 63 and the first discharge pipe 65. The water introduced into the body 51 moves to the space in which the first inlet port 55 is located through the partition through-hole 533. When the water is supplied to the space in which the first inlet port 55 is located, the ball 59 closes the first inlet port 55 due to the pressure of the water. As a result, the water introduced into the body 51 does not move to the tub body 21 but moves to the drainage pipe 7 through the outlet port 58.

Since the body 51 is connected to the inside of the tub body 21 through the exhaust duct 45, however, the channel switch unit 5 acts as a siphon brake. When the operation of the first pump 61 is stopped (the rotation of the impeller is stopped), therefore, the water that has moved to the drainage pipe 7 moves to the drain due to the weight thereof, but the water in the first discharge pipe 65 moves to the first housing 611 due to the weight thereof.

When the water in the first discharge pipe 65 moves to the first housing 611, the water discharged from the tub body 21 may be introduced into the tub body 21 through the first connection pipe 63.

If the water discharged from the tub body 21 is reintroduced into the tub body, which means that water to be drained remains in the tub, the washing performance of the laundry treatment apparatus may be reduced. In addition, when the hot air supply unit is operated, the amount of time necessary to dry the laundry may be increased.

In order to solve this problem, the laundry treatment apparatus 100 according to the present invention may further include a second drainage unit 8.

The second drainage unit 8 is a means for preventing water from remaining in the first drainage unit 6. As shown in FIG. 1, the second drainage unit 8 may include a second pump 81, a second connection pipe 83 for connecting the second pump to the tub body 21, and a second discharge pipe 85 for guiding the water discharged from the second pump 81 to the body 51 or the drainage pipe 7.

The second connection pipe 83 may be connected to any one of the lower region of the tub body 21 (the region of the tub body below a horizontal line passing through the center of the tub body), the first connection pipe 63, and the first housing 611. FIG. 1 shows an example in which the second connection pipe 83 is connected to the tub body 21 via the first housing 611, which is provided in the first pump.

In the case in which the second connection pipe 83 is configured to interconnect the second pump 81 and the body 51, the second connection pipe 83 may interconnect the second pump 81 and the first inlet port 55, or may interconnect the second pump 81 and the outlet port 58.

Figure 3:
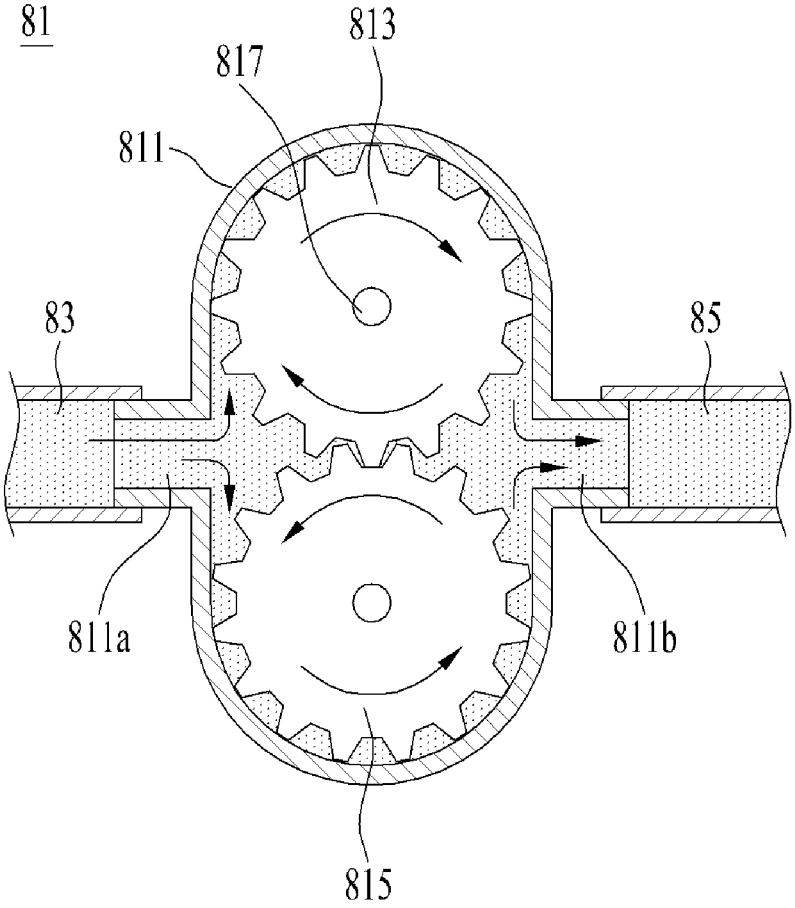
FIGS. 3 and 4 are views showing embodiments of a second pump provided in the laundry treatment apparatus according to the present invention.
Figure 4:
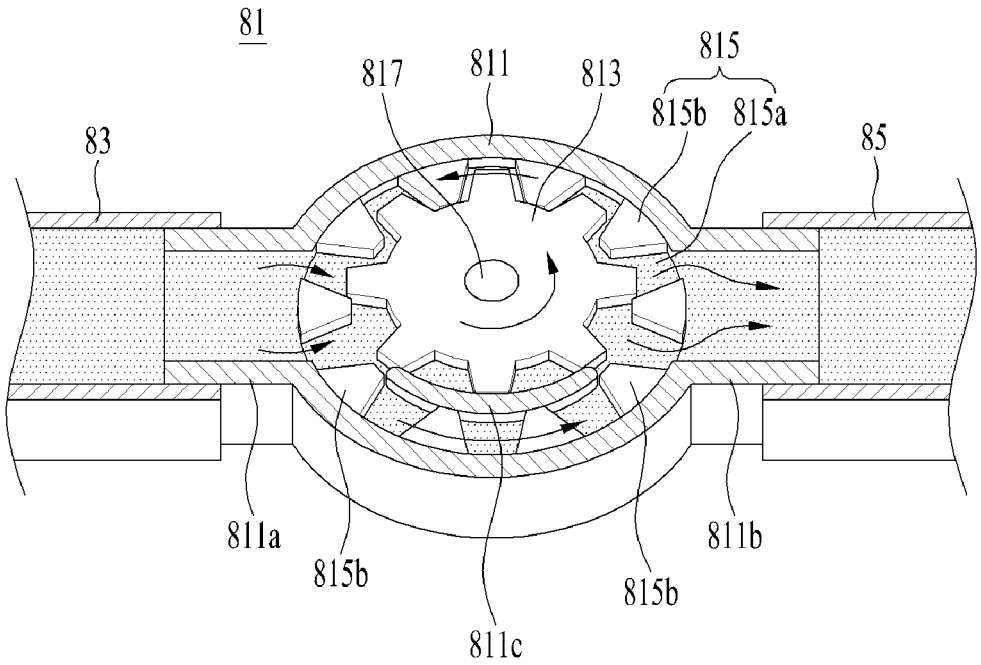

The second pump 81 may include a second housing 811 interconnecting the second connection pipe 83 and the second discharge pipe 85, and a first gear 813 and a second gear 815 provided in the second housing for moving water introduced into the second housing to the second discharge pipe 85 when rotated (see FIGS. 3 and 4).

The second pump 81 shown in FIG. 3 is configured such that a housing inlet port 811*a* and a housing outlet port 811*b* are connected to the second housing 811 through the second connection pipe 83 and the second discharge pipe 85 and such that the first gear 813 and the second gear 815 are rotatably provided in the second housing.

The first gear 813 and the second gear 815 are external gears, each of which is configured such that gear teeth are provided on the outer circumferential surface of a gear body. The first gear 813 is rotated by a second motor rotating shaft 817, and the second gear 815 is rotated by the first gear 813. When the second gear 815 is rotated by the first gear 813, therefore, water introduced into the second housing 811 through the second connection pipe 83 moves to the second discharge pipe 85 through a space between the gear teeth of the gears 813 and 815 and the second housing 811.

Meanwhile, the second pump 81, which includes the first gear 813 and the second gear 815, is configured to prevent water in the second discharge pipe 85 from moving to the second connection pipe 83 when the rotation of the first gear 813 and the second gear 815 is stopped, unlike the first pump 61. Consequently, it is possible to prevent water from being supplied into the tub body 21.

The second pump 81 shown in FIG. 4 is configured such that the first gear 813 is an external gear and the second gear 815 is an internal gear having a diameter greater than that of the first gear and such that the second gear is rotated by the first gear.

The second gear 815, which is an internal gear, includes a gear body 815*a* rotatably provided in the second housing 811 and a plurality of gear teeth 815*b* provided at the surface of the gear body and defining a space for receiving the first gear 813.

Since the diameter of the first gear is less than that of the second gear, a gap is formed between the gear teeth of the first gear and the gear teeth 815*b* of the second gear. In the gap between the gear teeth of the first gear 813 and the gear teeth 815*b* of the second gear 815 is provided a guide 811*c* for preventing the movement of water when the gears are not rotated.

In the second pump 81 of FIG. 4, the second gear 815 is rotated when the first gear 813 is rotated. When the second gear 815 is rotated, the water supplied through the second connection pipe 83 is introduced into the second housing 811 through the gap between the gear teeth of the first gear 813 and the guide 811*c* and the gap between the guide 811*c* and the gear teeth 815*b* of the second gear 815, and then moves to the second discharge pipe 85. When the rotation of the first gear 813 and the second gear 815 is stopped, however, the water in the second discharge pipe 85 is prevented from being supplied to the tub body 21. In the present invention, therefore, it is possible to prevent water from remaining in the tub body 21.

The laundry treatment apparatus according to the present invention may further include a connector 9 interconnecting the channel switch unit 5 and the drainage pipe 7.

As shown in FIG. 1, the connector 9 may include a connector body 91 fixed to the cabinet 1, a discharge pipe 97 provided at the connector body 91 for fixing the drainage pipe 7, and a first connector inlet port 93 and a second connector inlet port 95 provided at the connector body 91 so as to communicate with the discharge pipe 97.

In this case, a connector coupling pipe 581 may be provided between the outlet port 58 of the body and the first connector inlet port 93, and the second discharge pipe 85 may be connected to the second connector inlet port 95.

As is apparent from the above description, the present invention has the effect of providing a laundry treatment apparatus that is capable of preventing water from remaining in a tub.

It will be apparent to those skilled in the art that various modifications and variations can be made in the present invention without departing from the spirit or scope of the invention. Thus, it is intended that the present invention covers the modifications and variations of this invention provided they come within the scope of the appended claims and their equivalents.

What is claimed is:

1. A laundry treatment apparatus comprising:

a cabinet;

a tub provided in the cabinet for storing water;

a water supply unit for supplying water to the tub;

a drum rotatably provided in the tub for storing laundry;

a first pump comprising a first housing to receive water discharged from the tub and an impeller rotatably provided in the first housing to discharge the received water out of the first housing;

a drainage pipe extending through the cabinet at a height above the maximum possible level of water in the tub, the drainage pipe guiding the water discharged from the first housing outside of the cabinet;

a second pump comprising a first gear and a second gear rotatably provided in a second housing, into which water discharged from the tub is introduced, the second pump being configured to move the water introduced into the second housing to the drainage pipe when the first gear and the second gear are rotated, a circulation duct defining a channel for discharging air in the tub out of the tub and guiding the air discharged out of the tub into the tub;

a fan provided in the circulation duct for circulating the air in the tub;

a heater provided in the circulation duct for heating air;

an intake duct for introducing air outside the tub into the circulation duct;

an exhaust duct for discharging some of the air introduced into the tub out of the tub, wherein the intake duct and the exhaust duct remain open during operation of the heater and the fan, a body;

a partition for partitioning an interior of the body into two spaces;

a first inlet port located in one of the two spaces defined by the partition for introducing the air discharged through the exhaust duct into the body;

a second inlet port located in the other of the two spaces defined by the partition for introducing the water discharged from the first housing into the body;

an outlet port located in the space in which the first inlet port is located for discharging a fluid in the body to the drainage pipe;

a partition through-hole formed through the partition for allowing the space in which the first inlet port is located and the space in which the second inlet port is located to communicate with each other; and a ball for closing the first inlet port when water is introduced into the body and opening the first inlet port when no water is introduced into the body, the ball having a diameter greater than a diameter of the first inlet port.

2. The laundry treatment apparatus of claim 1, wherein:

one of the first gear and the second gear is an external gear, and the other of the first gear and the second gear is an internal gear having a diameter greater that a diameter of the external gear, wherein the internal gear is rotated by the external gear.

3. The laundry treatment apparatus of claim 1, further comprising:

a first connection pipe to connect the first housing to a lower region of the tub; and a second connection pipe to connect the second housing to one of the lower region of the tub, the first connection pipe, and the first housing.

4. The laundry treatment apparatus of claim 1, wherein the intake duct is provided in a channel along which the air in the tub is introduced into the fan.

5. The laundry treatment apparatus of claim 1, wherein the first inlet port and the second inlet port are disposed vertically with the partition disposed therebetween, and wherein the partition is provided with a recess, which is bent concavely toward the second inlet port such that the ball is located at a lower part of the first inlet port.

6. The laundry treatment apparatus of claim 1, wherein both the first gear and the second gear are an external gear.

7. The laundry treatment apparatus of claim 1, further comprising:

a first discharge pipe for guiding the water discharged from the first housing to the second inlet port; and a second discharge pipe for guiding the water discharged from the second housing to one of the drainage pipe and the body.

8. The laundry treatment apparatus of claim 7, wherein the second discharge pipe interconnects the second housing with either the first inlet port or the outlet port.

* * * * *